US011583710B2

(12) United States Patent
Berge et al.

(10) Patent No.: US 11,583,710 B2
(45) Date of Patent: Feb. 21, 2023

(54) AVALANCHE SURVIVAL DEVICE COMPRISING A BREATHING APPARATUS

(71) Applicant: SAFEBACK AS, Morvik (NO)

(72) Inventors: Tor Berge, Morvik (NO); Sigmund Andreassen, Bergen (NO); Andre Mjølhus, Bryne (NO)

(73) Assignee: SAFEBACK AS, Morvik (NO)

( * ) Notice: Subject to any disclaimer, the term of this patent is extended or adjusted under 35 U.S.C. 154(b) by 394 days.

(21) Appl. No.: 16/763,531

(22) PCT Filed: Nov. 13, 2018

(86) PCT No.: PCT/NO2018/050272

§ 371 (c)(1),
(2) Date: May 12, 2020

(87) PCT Pub. No.: WO2019/093906

PCT Pub. Date: May 16, 2019

(65) Prior Publication Data

US 2020/0360738 A1 Nov. 19, 2020

(30) Foreign Application Priority Data

Nov. 13, 2017 (NO) ..... 20171795
Nov. 12, 2018 (NO) ..... 20181446

(51) Int. Cl.
*A62B 33/00* (2006.01)
*A45F 3/04* (2006.01)
(Continued)

(52) U.S. Cl.
CPC ..... *A62B 33/00* (2013.01); *A45F 3/04* (2013.01); *A45F 4/04* (2013.01); *A63B 29/021* (2013.01); *A45F 2003/003* (2013.01)

(58) Field of Classification Search
CPC .. A62B 7/00; A62B 7/10; A62B 33/00; A45F 3/00; A45F 3/04; A45F 4/00; A45F 4/04; A63B 29/021
(Continued)

(56) References Cited

U.S. PATENT DOCUMENTS 4,590,951 A 5/1986 O'Connor
4,899,740 A 2/1990 Napolitano
(Continued)

FOREIGN PATENT DOCUMENTS

EP 1790386 A2 5/2007
EP 3042586 A1 7/2016
(Continued)

OTHER PUBLICATIONS

International Search Report for Application No. PCT/N02018/050272, dated Feb. 22, 2019 in 4 pages.
(Continued)

*Primary Examiner* — Lars A Olson
(74) *Attorney, Agent, or Firm* — Knobbe, Martens, Olson & Bear, LLP

(57) ABSTRACT

A device, method and system improve the breathable air quality of the environment in the region of a specific part of a body, such as around the mouth and nose area of a person buried in an avalanche. The device includes at least one inlet, at least one pump, at least one power resource, a controller, and at least one outlet. An inlet of the pump is constructed to act as a chamber. A first end of the chamber is connected to the inlet and a second end of the chamber is an opening towards the outside of the device. When the pump is activated, the pump will provide a vacuum in the chamber and suck air from the surroundings into the pump through the second end of the chamber and the chamber.

22 Claims, 7 Drawing Sheets

(51) Int. Cl.

| | |
|---|---|
| ***A45F 4/04*** | (2006.01) |
| ***A63B 29/02*** | (2006.01) |
| *A45F 3/00* | (2006.01) |

(58) Field of Classification Search
USPC ..... 128/202.13
See application file for complete search history.

(56) References Cited

U.S. PATENT DOCUMENTS

| | | | | |
|---|---|---|---|---|
| 5,490,501 | A | 2/1996 | Crowley | |
| 6,412,482 | B1 | 7/2002 | Rowe | |
| 7,520,923 | B2 * | 4/2009 | Marcoon ..... | A62B 23/025 128/206.13 |
| 2013/0149923 | A1 | 6/2013 | Walker et al. | |
| 2018/0021605 | A1 | 1/2018 | Bartkoski | |

FOREIGN PATENT DOCUMENTS

| | | | |
|---|---|---|---|
| EP | 3045208 | A1 | 7/2016 |
| JP | S60-68869 | A | 4/1985 |
| JP | 2010-510831 | A | 4/2010 |
| JP | 2011-518035 | A | 6/2011 |
| WO | 2017077074 | A1 | 5/2017 |

OTHER PUBLICATIONS

European Search Report issued for European Patent Application No. 18875231.5, dated Jul. 2, 2021 in 9 pages.
Japanese Office Action received in the corresponding Japanese Patent Application No. 2020-544320, dated Oct. 5, 2022 in 13 pages including English translation.

* cited by examiner

AVALANCHE SURVIVAL DEVICE COMPRISING A BREATHING APPARATUS

CROSS-REFERENCE TO RELATED APPLICATIONS

This application is the U.S. National Phase under 35. U.S.C. § 371 of International Application PCT/NO2018/050272, filed Nov. 13, 2018, which claims priority to Norwegian Patent Application No. 20171795, filed Nov. 13, 2017 and No. 20181446, filed on Nov. 12, 2018. The disclosures of the above-described applications are hereby incorporated by reference in their entirety.

FIELD OF THE INVENTION

The present invention relates to a device, method and system for improving the breathable air quality of the environment in the region of a specific part of a body, such as breathable air quality around the mouth and nose area of a person being buried in an avalanche.

BACKGROUND OF THE INVENTION

Snow avalanches in alpine and mountainous areas kill many people and animals each year, and have been the inspiration for development of many rescue and survival technologies. Some of these comprise radio equipment transmitting beacons of distress signals for aiding rescuers quickly to the right spot of the person in trouble. Other comprises floating devices, like airbags, for improving a person's ability to float on top of an avalanche in progress, and thus never become buried. Others again promote equipment comprising oxygen tanks and breading equipment.

The problems in prior techniques are that they are unreliable, for example because many require awareness of the person in need, and specific actions to be taken to make use of the equipment. Other problems relate to lack in sufficient efficiency, or they are too complex to wear/use.

SUMMARY OF THE INVENTION

It is the aim of the present invention to provide a solution reducing or eliminating one or more of the problems described above.

The present technology is based on the knowledge that the quality and content of for example breathable air in snow is sufficient for keeping a body of a person alive for a long time. The challenge in for example instances where a person is buried in an avalanche is not the air content in the surrounding snow, but the fact that heat and condense of the air breathed out by the person creates a layer around the mouth and nose area which becomes either water saturated or, even worse, freezes to ice and thus becomes non-permeable for the air. The oxygen in the layers of snow on the opposite side of the non-permeable layer created by the breathing activity of the person thereby becomes unavailable for the person.

The inventors of the present invention has further realized that most of the persons actually being victims of avalanches most often quickly lose control of limbs movement, for example the arms cannot operate any emergency equipment, or the victim may even be knocked unconscious in the process of being caught by an avalanche. Therefor most of the devices presented by the prior art, and certainly those techniques requiring physical activation procedures to be followed by the victim, is not very efficient or even fails completely to work in a real life situation.

The present invention reduces, and may even eliminate, required conscious action of the victim, and operates as long as the device receives sufficient power. It further relies on the abundancy of breathable air comprised in the surrounding of the victim.

It shall be understood that the embodiments only describe the principle of the invention, and that there may be additional ways to implement the present invention. It is the associated claims that shall define the protection scope of the present invention.

BRIEF DESCRIPTION OF THE DRAWINGS

Additional features and advantages of the present disclosure are described in, and will be apparent from, the following brief description of the drawings and the more detailed description of the embodiments

BRIEF DESCRIPTION OF THE DRAWINGS

Figure 1:
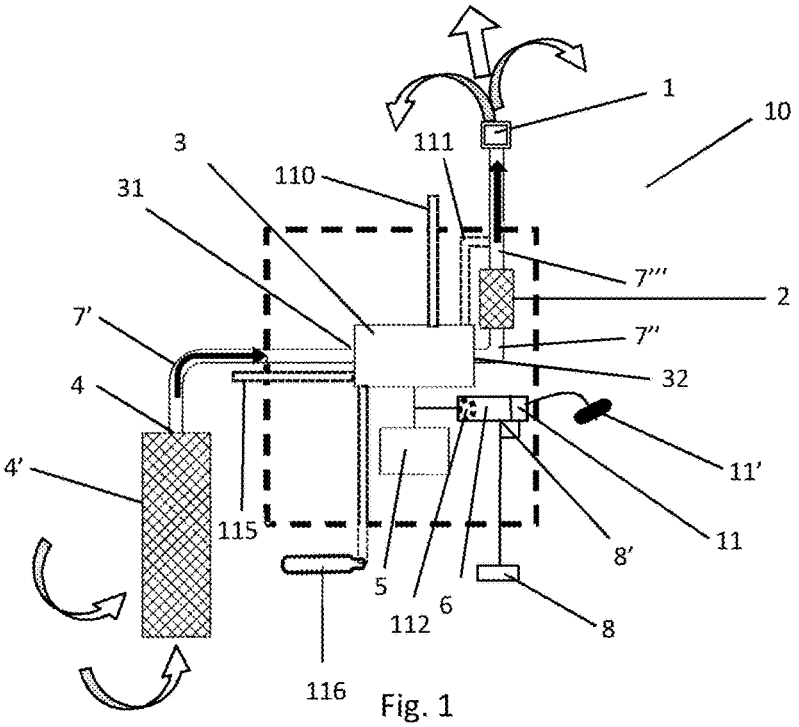
Figure 2:
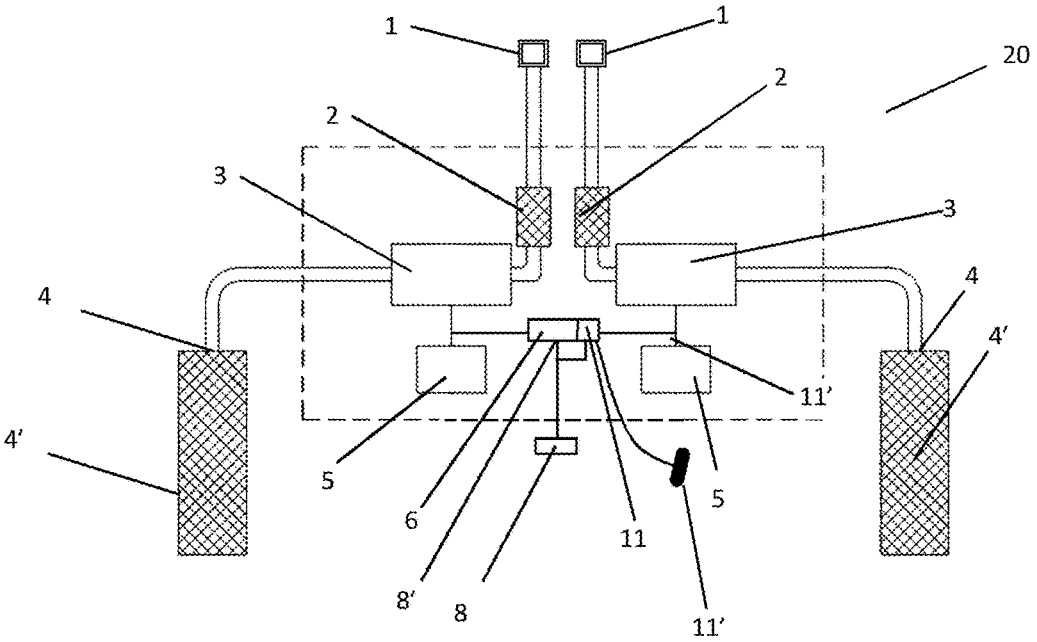
Figure 3A:
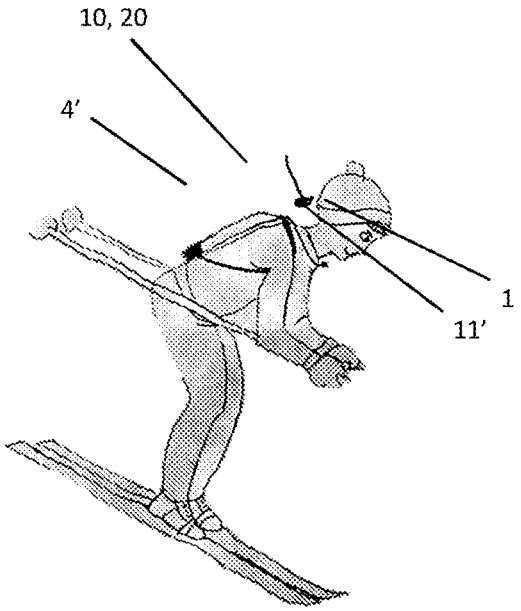
Figure 3B:
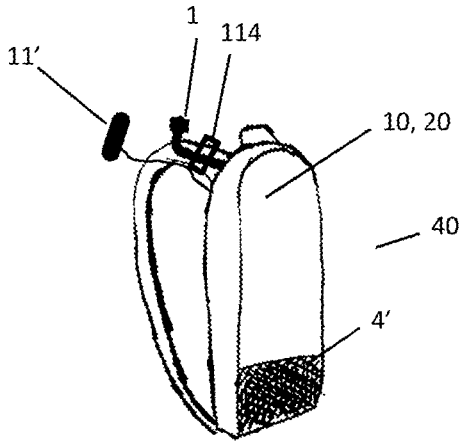
Figure 4:
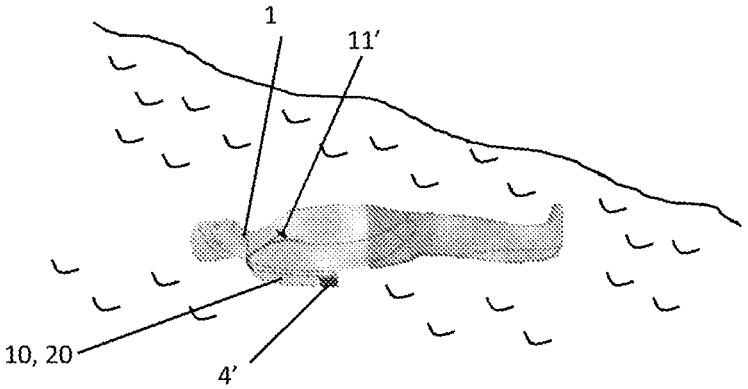
Figure 5:
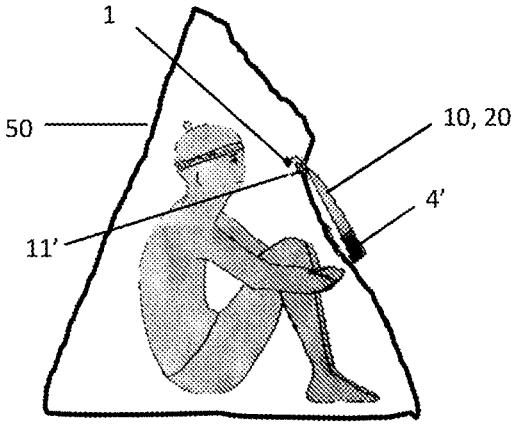

FIG. 1—Conceptual diagram of invention
FIG. 2—Conceptual diagram of invention; dual channel
FIG. 3A—One embodiment of inventive concept, standby
FIG. 3B—Backpack system of invention
FIG. 4—Illustration of inventive concept, activated.
FIG. 5—Alternative usage cases: snow cave and tent
FIG. 6—Method flow chart
FIG. 7—System description
FIG. 8—Backpack embodiment, multiple inlet channels
FIG. 9—Backpack and helmet
FIG. 10—Backpack side mounted embodiment of invention
FIG. 11—Details of side mounted embodiment of invention
FIG. 12—Skier wearing backpack embodiment of invention
FIG. 13—Driver of snowmobile wearing embodiment of invention and helmet.
FIG. 14—Victim of avalanche wearing embodiment of invention in a backpack

DETAILED DESCRIPTION OF THE PREFERRED EMBODIMENTS

Breathable air is used in this document to illustrate one type of embodiments, but it should be understood that the device may be used in a variety of environments The present invention will now be described in more detail with reference to the non-limiting drawings.

In one embodiment of the present invention as outlined in FIG. 1, the breathable air quality improvement device 10 comprise at least an inlet 4, a pump 3, a power source 5 and an outlet 1, and a pipe or conduit 7', 7'', 7''' connecting the elements for providing a path for flow of a breathable air, from the inlet 4, via the pump to the outlet 1. The pump 3, when activated by sufficient power from a power source 5, such as a battery, will provide a flow of breathable air from the inlet 4 to the outlet 1.

The at least one inlet 4 is connected to a pump inlet 31 of the pump 3, and the at least one outlet 1 is connected to a pump outlet 32 of the pump 3, the pump may when activated pump air from the inlet 4 to the outlet 1.

The pump may be activated by a controller 6 which may be comprised of a manual switch 11' or automatic activation unit 11. Typically the controller 6 comprises an avalanche situation detection mechanism/sensor 8, which automatically activates the switch 11, and thus activates the breathable air quality improvement device. The avalanche situation detection mechanism/sensor 8 may be overridden to activate breathable air quality improvement device 10, 20 in non-avalanche situation where improved breathable air quality is wanted.

A manual switch 11' may be arranged to be latched onto a carrying strap of the breathable air quality improvement device 10.

The pump may be operated in more than one mode, for example high, medium and low, where the low mode can be a power save mode. The controller 6 may comprise detectors and activators for automatically regulation of mode of operation of the pump, for example as a result of power resource capacity, such as battery capacity reserve, detected by a detector (not shown). As an example only, this may be facilitated such that the pump 3 has full effect until 50% of power resource remains, and switches automatically to medium mode which lasts until 25% of the power resources remain, and then the mode of pump operation automatically switches to a power save mode, low mode.

The mode of pump operation selection may be manually selected by a local or remotely connected regulator switch 11'.

Such a mode controlling regime may prolong the operation time considerably when a limited power resource capacity for the breathable air quality improvement device 10 is available.

In a further alternative embodiment of the present invention as illustrated in FIG. 2, a dual breathable air quality improvement device 20 is provided. In such a system the capacity of the breathable air, such as air provided may be increased to be adapted to an environment requiring distributed load of the environment around the inlets 4. For example in an emergency situation where a person is trapped in a snow avalanche, the surrounding snow may not provide sufficient amount of air/oxygen in one spot only, and it may be necessary to provide inlets in more than one location.

The invention may have multiple numbers of instances of breathable air quality improvement device 10 arranged to work together to improve the quality of breathable air in an environment around the outlets 1.

Another reason for duplicating or having a plurality of breathable air quality improvement devices 10 may be redundancy. An arrangement providing redundancy may also comprise a test function implemented in for example the controller 6. The test function frequently tests the operation status of a main breathable air quality improvement device 10, and if an operation malfunction is detected activates another breathable air quality improvement device 10 available in the redundancy setup.

A controller 6 in a redundancy setup with multiple breathable air quality improvement devices 10 may serve all or some of the breathable air quality improvement devices 10, as indicated in FIG. 2. It shall be understood that the controller in other embodiments may be arranged in more than one device, for example one for each breathable air quality improvement device 10, 20, or the operation switch 11 may be comprised in a multifunction unit 6, whilst sensors 8 may be arranged in a separate module/device, and may be organized in unique modules/devices for each breathable air quality improvement device. If there is more than one controller 6, it may be possible to couple these in a hierarchical way, such that for example a secondary controller may be the first to identify an emergency situation, and activation of the first air quality improvement devices 10 may be initiated by this. Sensors may be connected to one, more or all controllers 6 in a hierarchical setup. These setups may increase the redundancy capacity.

The breathable air quality improvement device 10 may improve the quality of output breathable air by comprising a filter 2 for cleansing the breathable air. The filter may be arranged to be in the pipe or conduit 7', 7'', 7''', for example in the outlet pipe 7'''. The filter may be arranged at locations of the breathable air quality improvement device 10, for example in the inlet duct 7'.

When air is supplied by the breathable air quality improvement device 10, a typical filter may be a $CO_2$ filter. Other filters may be provided, such as for example water/snow/ice removal filter.

In one embodiment of the invention, the breathable air quality improvement device 10, 20 comprise a feedback duct 110, for fetching air from the space around the outlet 1 and recirculate it through the pump (3) and $CO_2$ filter (2). The controller 6 may control the operation of the feedback duct 110 supplying air to the pump 3 when the level of $CO_2$ detected in the outlet 1 area reaches a preset level.

The filter(s), such as a $CO_2$ filter, may for different reasons be malfunctioning, and prohibit air flow through the filter. One embodiment of the breathable air quality improvement device 10, 20 may comprise a bypass duct 111, which is activated by the controller 6 to supply air directly from the pump to the outlet 1 when the filter is detected to be malfunctioning, for example by detecting a lower than expected flow of air through the pump. Other sensors may detect malfunction of the filter(s). The bypass duct 111 may also be activated when for example air quality level in the outlet 1 surroundings are safely below critical levels and the air flow through the pump 3 has acceptable quality.

A typical $CO_2$ filter may be chosen to have a capacity of many times the possible air volume pumped by available power resource 5, such as battery.

Power resource 5, may be comprised of a battery, or other power generating device, for example a fuel cell instead of or in combination with a battery.

A typical embodiment of the breathable air quality improvement device 10 will also comprise an inlet 4 comprising an inlet protection device 4' for protection of the inlet against being clogged by snow, water or other substances. The inlet protection device may be formed by a light weight protection mesh, for example by a hard plastic or carbon material, and the mesh may be filled with a gas permeable material such as a polyurethane sponge or other. In a further embodiment the inlet protection device 4' will be gas permeable, but fluid non-permeable. The protection device may be shockproof.

The outlet 1 may be arranged in wearable device/equipment 114 to ensure a position close to nose/mouth of person wearing the breathable air quality improvement device 10, 20. Wearable device may comprise a fastening device (not shown) arranged on for example the jacket collar/the backpack strap or inside for example a helmet.

Now a typical embodiment of a breathable air quality improvement device 10 will be discussed.

A typical use for the breathable air quality improvement device 10 of the invention is to provide an emergency pack for mountaineers spending time in avalanche prone areas. In an avalanche situation, a person trapped below the surface of the snow has oxygen supply from the surrounding snow only a maximum of a few minutes. The snow itself will in most cases comprise sufficient oxygen surplus for a person to be able to survive, if the person could access the oxygen enclosed in the snow in the vicinity of the mouth/nose. This is however not the case, since condense from the breath of the person buried in the snow very quickly saturates the surrounding environment around the head with humidity, which very often creates an ice layer or water saturated layer transforming the close by snow to a non-permeable material. This non-permeable shell around the mouth/nose area will prohibit the oxygen from the close by snow volume to reach the buried person, and the person will very quickly suffocate because of the $CO_2$ buildup in the breathing environment. To carry an oxygen supply for emergency use might postpone the inevitable outcome if the victim is not rescued, but it is cumbersome to carry oxygen supplies able to supply life sustaining oxygen for a long period.

FIG. 3A illustrates the breathable air quality improvement device 10 of the present invention worn by a skier/mountaineer as a backpack 40. A backpack 40 assembly is illustrated in one embodiment in FIG. 3B. The backpack 40 provides an inlet 4, 4' environment away from the face area of the backpack 40 wearer. The outlet 1 is arranged to be located close to the face area of the backpack 40 wearer. The pump 3, power source 5, such as a battery, and controller 6 may be arranged inside the backpack 40.

The backpack 40 comprising the breathable air quality improvement device 10, may further provide a protective case around the parts of the invention to avoid malfunction due to external forces or impacts. The pipe and/or the conduit 7', 7", 7'" may be designed to be resistant to bending and also enforced to avoid breakage or leaks when the wearer is in an emergency situation, such as when caught by an avalanche or when buried under snow.

The breathable air quality improvement device 10 of the invention is typically in one of: shut off, stand by or active state.

When shut off, typically when stored, none of the elements of the air quality improvement device 10 are active.

When in a stand by state, the breathable air quality improvement device 10 controller 6 is monitoring status of the switch 11, both the automatic activation unit and the manual on/off switch 11'. If either is activated, the controller 6 starts the pump 3, and air is pumped from the inlet 4 to the outlet 1. The air quality improvement device 10 has switched into the active state.

The controller 6 may comprise a gyrosensor 8, that will detect a movement pattern equal to what would be expected to be caused by an avalanche. For example if the bearer is caught by an avalanche as exemplified in FIG. 4, the automatic activation unit may be activated by the gyrosensor 8, and the controller starts the pump 3. The pump will pump air form the inlet 4 on the backside of the person carrying the backpack 40 to the outlet 1 close to the face area, and thus transfer oxygen from the surroundings, outside the ice layer or water saturated layer to the face area of the victim. This way the ice barrier built up by the victimized persons breathing will not prohibit the environment around the face to close the access to the surrounding oxygen rich air contained in the snow. The pumped airflow will also displace the $CO_2$ saturated air around the nose and mouth.

In such an instance there will be advantageous if the inlet is arranged as far from the nose and mouth area of the bearer, for example as low as possible in the backpack 40. The inlet 4 would further improve efficiency if the inlet was enclosed by an inlet protection device 4' such as a filter or material preventing the snow to be packed closely around the inlet. The bigger the area of the inlet protection device 4' is, the more surface is provided for catching air from the surrounding snow.

When the breathable air quality improvement device 10, 20 is activated and an ice layer is built up around the head region of the victim the $CO_2$ level will quickly increase in the berating environment. The breathable air quality improvement device 10, 20 may advantageously comprise one or more filters 2 for purifying the air, such as filter for catching $CO_2$. Filters 2 may be arranged close to the outlet 1, but could also be arranged close to the inlet 4 for prohibiting "bad" air to pollute the inflow air quality.

Optionally, the controller 6 may also initiate a distress signal transmitter, not shown, and other signal transmitting devices or visual/physical tracking devices, not shown. The optional transmitter may even transmit data from the various sensors 8 of the breathable air quality improvement device 10, 20, such as from sensors provided in the device 10, 20 for measurement of power level, filter status, operation malfunctions.

Figure 7:
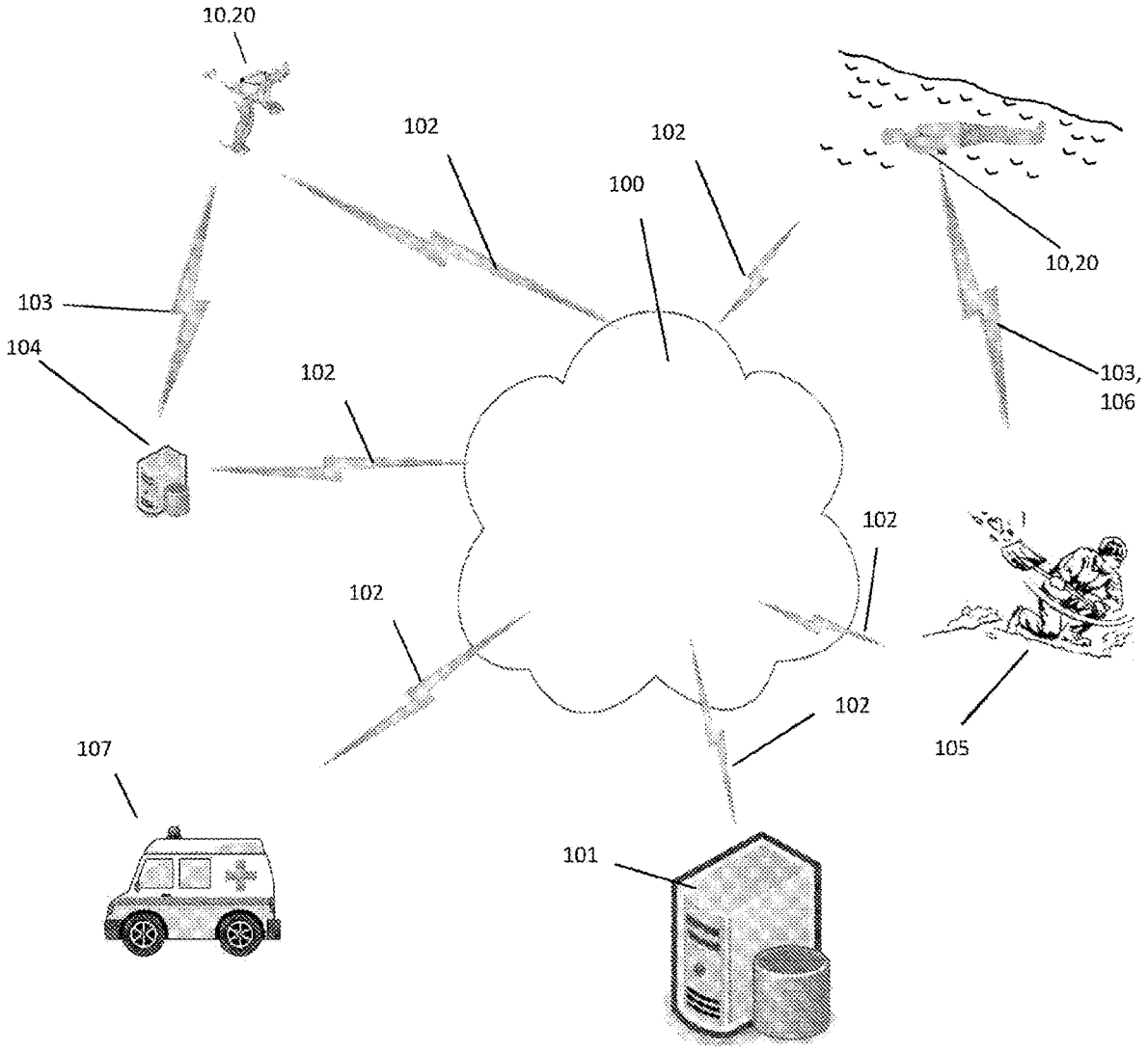

In an optional embodiment the breathable air quality improvement device 10, 20 is provided with one or more sensor input interfaces 8', for connection to for example body attached sensors 8, able to detect physical condition of the person carrying the breathable air quality improvement device 10, 20. The controller 6 may be able to process and optionally convey the information to a remote communication unit 101, 104, 105, and also receive control instructions from the remote communication unit 101, 104, 105 as illustrated in FIG. 7. The controller may be able to alter the level of air supply through the breathable air quality improvement device 10, 20 based on changes or levels in the data provided by the sensors 8.

The breathable air quality improvement device 10, 20 can be adapted for a number of advantageous usage scenarios such as the above discussed backpack 40 for avalanche emergency use. The backpack 40 or other, such as a bag, embodiments of the breathable air quality improvement device 10, 20 could be optimized for use in for example an emergency snow-cave or tent camp 50 as exemplified in FIG. 5. If a skier or the like is for example surprisingly caught by a storm, and time allows only digging a rude/shallow snow cave, the air supply may be a critical factor for survival. The breathable air quality improvement device 10, 20 could then be used to fetch air from away from the face area by either providing an extendable outlet pipe 7', 7" such that the breathable air quality improvement device 10, 20 could be arranged outside the shallow snow cave, and the extendable outlet pipe 7", 7'" could be arranged close to the face area of the skier, or providing an extendable inlet pipe 7' which could be placed in a sufficient distance from the face area, for example from the outside of the cave/tent 50, and further a manual switch 11' of the controller 6 may be provided to switch the breathable air quality improvement device 10, 20 to desired pump mode. Depending on the volume of free space the person in distress has been able to dig around himself, the mode of operation may be variably set to provide sufficient air supply, but at the same time save energy for longest possible use.

Other uses may for example be tent 50 which may be buried in snow in a snowstorm, thus closing normal ventilation features. The inlet may be extended to the outside far enough to fetch air supply form outside the ice buildup around the tent cloth.

The automatic activation unit 11 may be triggered of a various detected events, for example by one or more sensors/detectors 8 connected to the automatic activation unit 11, comprising but not limited to: movement caused by an avalanche, $CO_2$ level above preset threshold, weight load/pressure, g-forces, or other sensor 8 input crossing activation threshold such as: an oxygen content in a person's blood stream, heart rate or body temperature, or other.

In one embodiment wherein the invention is used as a backup oxygen supply device, for example when a person is spending time in a shallow snow cave. A person spending time in an environment with high $CO_2$ content might not realize the danger, and may suffocate. The present invention, breathable air quality improvement device 10, 20, may comprise a sensor 8 for $CO_2$ content and upon reaching a level considered dangerously low automatically start supplying air fetched from outside the restricted area. The breathable air quality improvement device 10, 20 may additionally comprise an alarm 112, such as a sound alarm, visible light alarm or other, the alarm 112 may be activated by the controller 6 to alert the person of the detected dangerous level of $CO_2$. The alarm 112 may be incorporated in the controller 6 or be arranged as a separately connected alarm device. The alarm 112 may ensure a better power use scheme of the breathable air quality improvement device 10, 20, since it may enables the user or controller 6 to switch the breathable air quality improvement device 10, 20 on and off, manually or automatically, based on the quality of air in the outlet 1 area.

In a further embodiment of the present invention the breathable air quality improvement device 10, 20 can be used in combination with one or more further lifesaving equipment features/devices, such as for example a balloon safety device which is provided to inflate in a snow avalanche situation. The further lifesaving equipment may be controlled by the automatic activation unit 11 of the breathable air quality improvement device 10, 20, or by the manual switch 11' of the breathable air quality improvement device 10, 20. Other further lifesaving features may be for example: distress beacon radio signal, emergency flash light, sirens, or other.

In a further embodiment of a breathable air quality improvement device 10, 20 wherein a combination with a balloon safety device which is activated by expansion of oxygen from a compressed $O_2$ tank, it is provided an additional inlet 115 arranged to connect the inside of the balloon with the pump 3, wherein the flow of oxygen from inside the balloon is opened when the balloon has been filled with oxygen, and surplus of oxygen from the other inlets 4, 4' is not providing sufficient oxygen flow through the breathable air quality improvement device 10, 20.

In yet a further embodiment of a breathable air quality improvement device 10, 20, a container 116 filled with compressed oxygen may be added to provide oxygen through the pump when the inlet 4, 4' is not providing enough oxygen. The additional supply may be controlled by the controller and sensors identifying unacceptable levels arranged on the inlet 4, 4'measuring flow rate or oxygen level or in the outlet environment measuring $CO_2$.

In yet a further embodiment of a breathable air quality improvement device 10, 20, the balloon backup feature vis additional inlet 115 and the additional container 116 holding compressed oxygen may be combined to provide even further operation time span of the breathable air quality improvement device 10, 20.

In yet a further embodiment of a breathable air quality improvement device 10, 20, a second life saving equipment may be arranged to co-work with the breathable air quality improvement device 10, 20, the second life saving equipment may for example be air inflating balloon for avalanche buoyancy, container comprising compressed oxygen, airbag for body protection, body heating equipment optionally powered by the power resource 5 of the breathable air quality improvement device 10, 20, or other.

Figure 6:
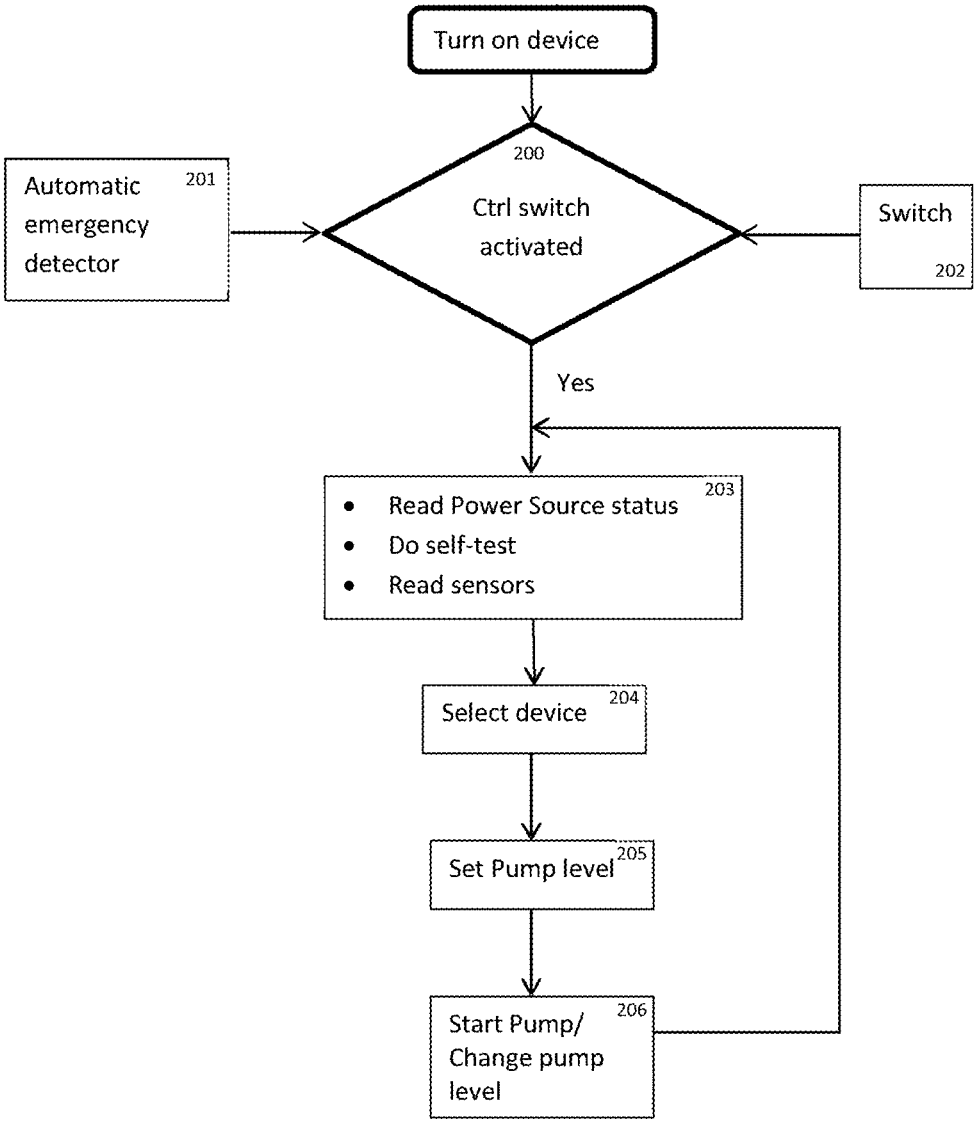

FIG. 6 is a flow diagram explaining the method of operation for on optional embodiment of the invention wherein once the breathable air quality improvement devices 10, 20 is turned on the control switch activation 200 awaits either an automatic emergency detector 201 input signal for activation or a manual controlled signal from a switch 202. When such input signal is received, the control unit may initiate operation by performing a self-test and/or reading power status 203 of the battery. If the invention comprises more than one breathable air quality improvement devices 10, 20, the controller will select which devices 204 is to be activated. This decision may be influenced by the power level or other sensor inputs. If the pump(s) can be ran at different capacity levels, the data read by sensors and power level may additionally be evaluated for defining at which level 205 the pump is to operate. If pump level is to be changed, the pump is then instructed 206 to run at the new level. The controller 6 reruns the self-test to pump activation operations 203-206 at a preset time interval, for example—every 30 second.

One regime controlling the pump capacity level setting may consider lowering the power consumption by only providing enough breathable air as to barely keep the person alive in order to maximize the lifetime of the power source. If sensors detect disturbing heartbeat, the rate of breathable air may be increased for a period of time. Another regime may include communication with a remote rescue group, which may estimate the time of arrival, and the power consumption may be averaged over the time until estimated rescue.

The breathable air quality improvement device 10, 20 may provide advantageous and lifesaving aid in further environments than in the avalanche/snow environments discussed above. Such environments may for example be: tight environments wherein workers executing work with limited air supply such as well, pipes, crawling spaces, caves, manure bin, and other.

FIG. 7 illustrates a system embodiment of the invention wherein the controller 6 comprises a wireless communication unit able to communicate a beacon 106 searchable by a searching party 105. The wireless communication unit may also be able to transmit 103 sensor 8 readings, in order for the searching party to be able to take intelligent decisions, such as send for emergency transport 107. The communication unit may further be able to communicate with a cloud or wide area network 100, and through this communicate 102 with a server service 101, the searching teams 105, the transport 107 or a local alarm station 104. This can typically be an emergency service able to react to distress signals, and which may communicate 102 with appropriate control rescue teams 105 and emergency transportation 107.

Communication transfer medium 102, 103, 106 may be one of, wireless LAN or WAN, Bluetooth, WIFI, mobile network, radio communication, or other communication medium.

A further system feature may comprise a local alarm station 104 provided on site, for example at selected mountain locations. Each invention device 10, 20 may at preset intervals communicate 103 with a local alarm station 104 to identify presence and no-distress signal. When an emergency situation is detected, the local alarm station 104 may be programmed to provide a list of persons out of danger, and who's in a danger zone.

Figure 8:
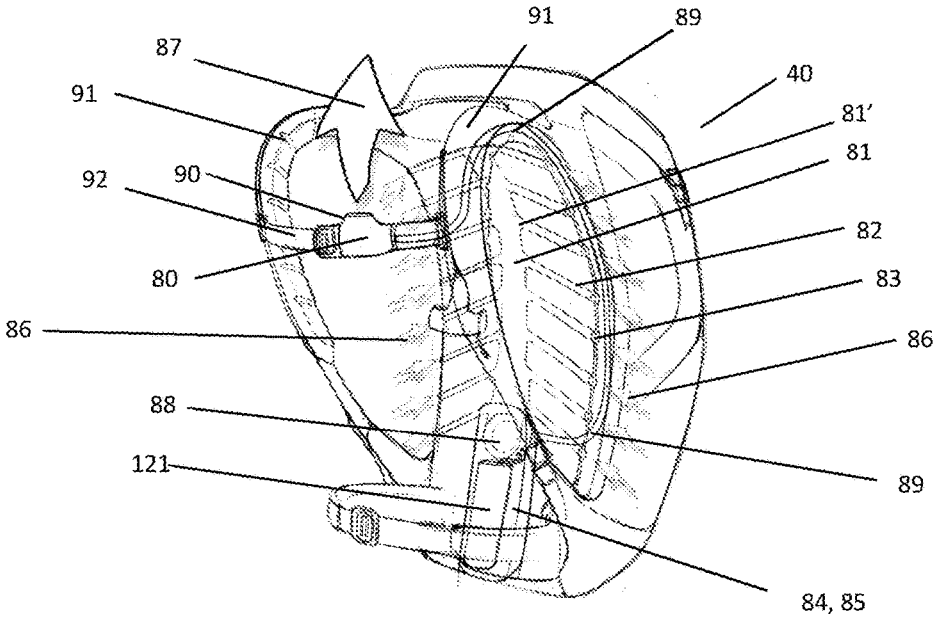
Figure 9:
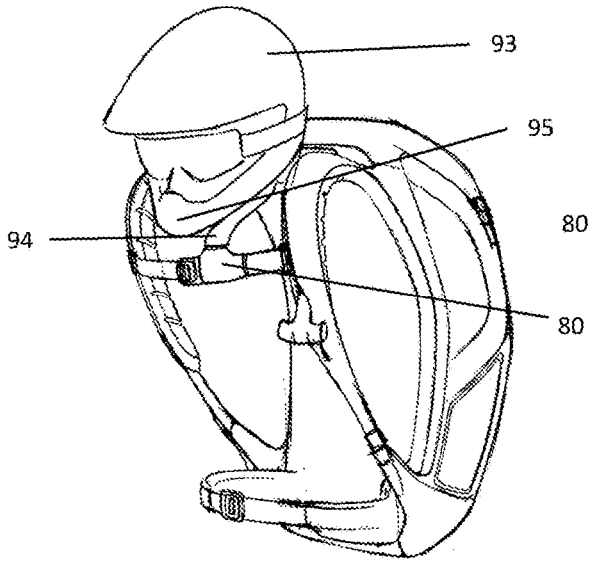

A further embodiment of the invention is illustrated in FIG. 8. An inlet channel is integrated with a frame, such as for example the back plate of a backpack 40, wherein the inlet channel is constructed as a plurality of distributed inlet channels 82 comprising at their most peripheral end corresponding inlet openings 83 which are set apart arranged in a distributed pattern enabling air to be collected from the different surroundings of each of the inlets opening 83. Thereby, enabling collecting air from a larger volume of surrounding area than if the inlet was only in one location. The plurality of the distributed inlet channels 82 is in its central end coupled to a pump 85, optionally via a central inlet channel 81. Each distributed inlet channel 82 may connect at its peripheral end the corresponding air inlet (83) to the central inlet channel 81 in a connecting junctions 81', the central inlet channel 81 may have one or more connecting junctions 81' connecting to each of, or group of, distributed inlet channels (82). In one embodiment some or all of the central inlet channel 81 and/or the plurality of the smaller distributed inlet channels 82 and corresponding inlet openings 83 may be constructed for and be filled with a formable air permeable foam material, such that the air transported by the channels is at the same time filtered. Filter properties may vary depending on need, pump capacity and other. The formable foam material may also partially contribute to maintain the form of the channels 81, 82, and thereby also lower the requirements to the material used in the walls of the channels 81, 82. For example it could suffice to use channel wall material of light weight poly based materials, light weight woven airtight material or the like.

In the example of integrating the central inlet channel 81 and the plurality of the smaller inlet channels 82 in the frame of a backpack 40 as shown in FIG. 8, the smaller inlets are arranged in the periphery of the back plate, and the inlet openings 83 are either on the side of the back plate of the back pack 40, or in the close vicinity of the side edge of the back plate on the side facing towards the person carrying the backpack 40. Each inlet opening 83 is coupled to the central inlet channel 81 by the distributed inlet channel 82, such that air easily can be sucked into the central inlet channel 81 from each inlet opening 83.

The pump 85 may be integrated with a battery in an enclosed casing 84 attached to the inlet openings 83 via the distributed inlet channels 82 and the central channel 81. The pump 85 will when activated generate a vacuum in the distributed inlet channels 82 and the central channel 81, combined forming or acting as a chamber, and by that suck air from the surrounding via the inlet openings 83 and through the distributed inlet channel 82 and the central channel 81. The combined strength of the channels 81, 82 and the optional filling comprising the formable foam material must be able to maintain a form sufficient to withstand the vacuum without collapsing.

A further advantage of the embodiments shown in the figures is achieved by integrating an air supply pipe 89 for transporting air from the pump 85 to the facial area in the backpack 40 and one or more of shoulder harness 91, sternum strap 92, stabilizer straps or the like. Thus the air supply from the pump 85 may be transported through the air supply pipe 89 wherein the air supply pipe 89 will be concealed in the back plate, and/or shoulder harness, and/or sternum strap, and/or stabilizer straps of the backpack 40, and thereby be protected from damage from the surroundings.

An outlet device 80 providing an outlet opening 90 for the air supply pipe 89 may be provided at the end of the air supply pipe 89, at the opposite end of the air supply pipe 89 than the end being connected to the pump 85. The outlet 80 being arranged close to a carrier's facial area. The outlet device 80 may be provided with further outlet filtering material to ensure the outlet is not packed with snow and ice. The outlet filter material may additionally be provided with a heating device (not shown) to prohibit icing clogging the air outlet opening 90.

In order to facilitate providing improved air at more precisely defined enclosures, such as when the user of the air quality improvement device wears a full face helmet 93 and air must be supplied inside the helmet, a pipe extender 94 may be connected, for example by a quick snap locks, in one end to the outlet opening 90 of the outlet device 80, and in the other end connected to the inside of the helmet 93, for example to a helmet outlet device (not shown). In one embodiment the helmet outlet device may be integrated in the helmet, for example in the jaw protection portion 95.

Figure 10:
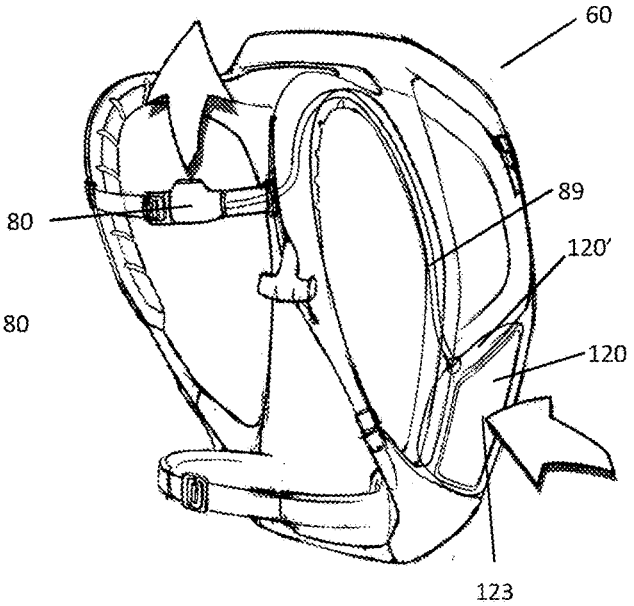
Figure 11:
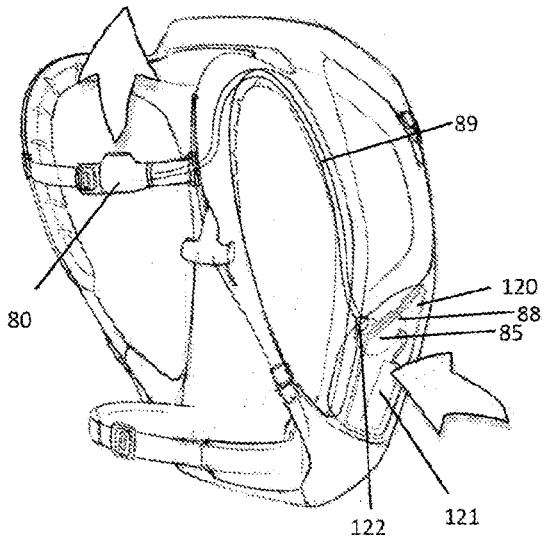

In a further embodiment, the pump, battery and distributed inlet channels and openings as shown in FIG. 8 may be comprised in a combined pump unit 120 comprising a chamber 120', a pump 85, a battery, an air inlet being comprised of the opening 123 of the chamber 120' facing towards the surroundings, and a filter, all in one device adapted for integration into the side of a backpack or the like as shown in FIG. 10 and FIG. 11. In this latter embodiment parts of or the hole side of the carrying device, such as the backpack 40, may be used for encompassing the inlet opening. An integrated side cover providing an air permeable barrier between the inlet of the combined pump unit may advantageously be provided, the side cover providing an extra protection towards external forces and items. The pump 85 in the pump unit 120 then will suck air from the surrounding into the pump inlet 82 from the inlet opening, and feed the air supply pipe 89 which is connected to the outlet 122 of the pump 85 and which transports the air to the outlet device 80. Further air filtering and support in the chamber may be provided by filling the chamber partially or completely with a formable air permeable foam material, thus providing a further barrier for debris, snow, fluids and other particles to be sucked into the pump.

The device shown in FIG. 8 may be implemented in a wearable jacket provided with a back plate for encompassing the inlet channels and the central channel, or a carry on back plate (not shown), or the like.

Figure 12:
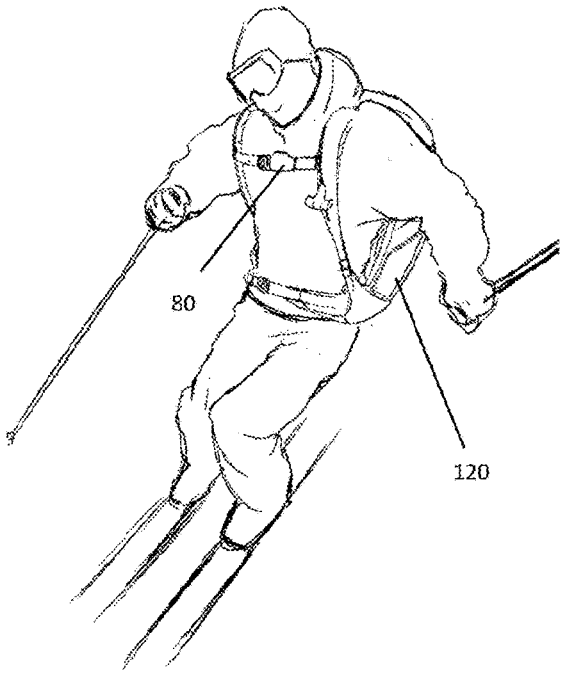
Figure 13:
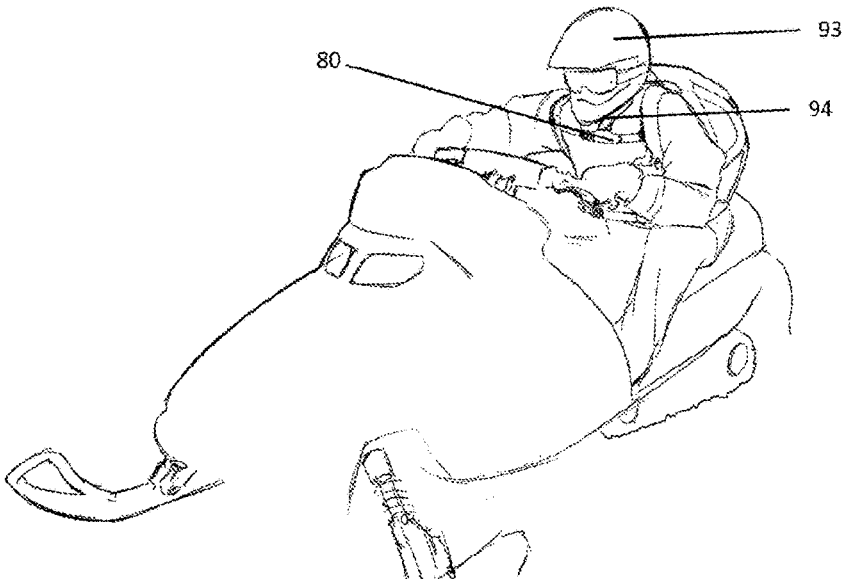
Figure 14:
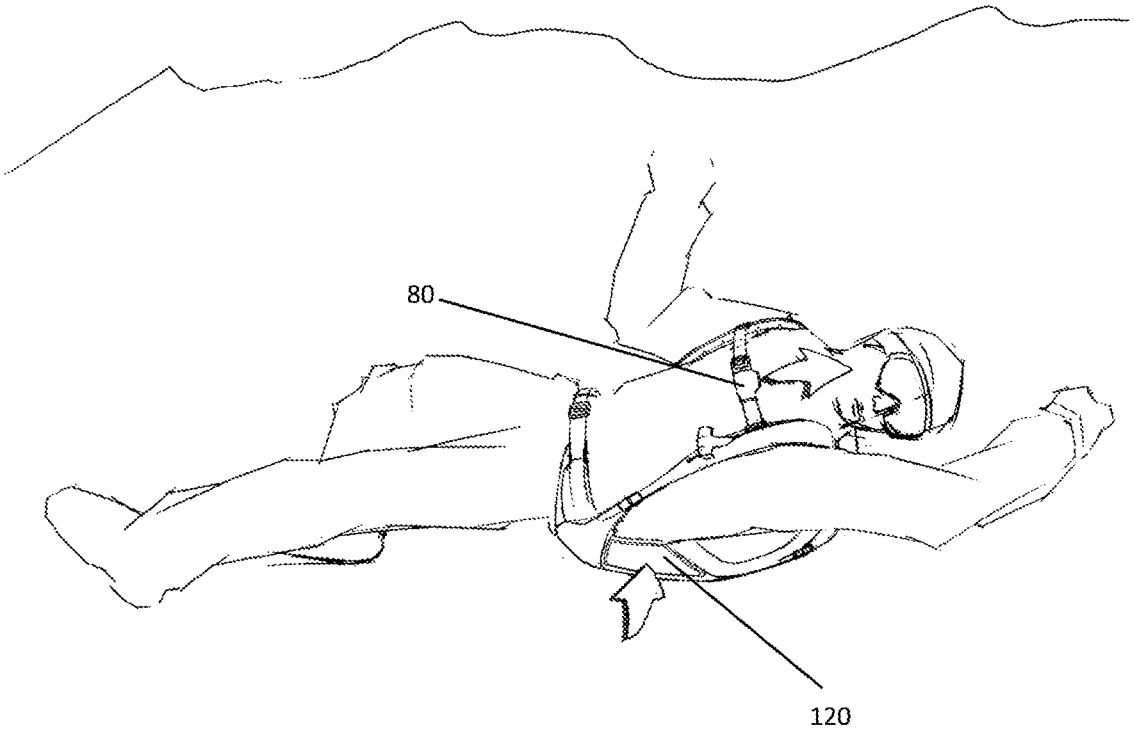

The use scenarios shown in FIGS. 12, 13 and 14 all show the latter embodiment of the pump unit 120, for convenience of the drawing clearly identifying this unit. It is however the inventors intention that the embodiment shown in FIG. 8 comprising the inlet openings 83 via the inlet channels 82 and the central channel 81 integrated in the back frame of for example the back pack could be used in the scenarios shown where a downhill skier wears the back pack as shown in FIG. 12, or the version shown in FIG. 13 worn by a snowmobile driver also using a helmet 93 and comprising the pipe extender 94 connected in one end to the outlet device 80, or as shown in FIG. 14, where a person has been buried in an avalanche.

The following embodiments may define present invention wherein:

A first embodiment of the device 10, 20 for improving the breathable air quality in an environment, comprise:

at least one inlet 4, at least one pump 3, at least one power resource 5, a controller 6, and at least one outlet 1 wherein the at least one inlet 4 is connected to a pump inlet 31 of the pump 3, and the at least one outlet 1 is connected to a pump outlet 32 of the pump 3, the pump will, when activated, pump air from the inlet 4 to the outlet 1.

A second embodiment of the device 10, 20 according to the first embodiment of the device 10, 20, wherein the connection between the at least one inlet 4 and the pump inlet 31 further comprise an inlet pipe segment 7' for enabling a more distant arrangement of the inlet 4 relative the pump inlet 31.

A third embodiment of the device 10, 20 according to any of the first to second embodiment of the device 10, 20, wherein the connection between the at least one outlet 1 and the pump outlet 32 further comprise an outlet pipe segment 7", 7'" for enabling a more distant arrangement of the outlet 4 relative the pump outlet 32.

A fourth embodiment of the device 10, 20 according to any of the first to third embodiment of the device 10, 20, wherein any of the pipe segments 7', 7", 7'" inlet 4, outlet 1 or the pump 3 is further comprising a filter 2 for filtering the air supplied by the device 10.

A fifth embodiment of the device 10, 20 according to the fourth embodiment of the device 10, 20, wherein the filter 2 is a $CO_2$ filter for removal of $CO_2$ from the air supplied by the device 10.

A sixth embodiment of the device 10, 20 according to any of the first to fifth embodiment of the device 10, 20, wherein the controller 6 comprise an automatic activation unit 11 for setting and controlling an operating mode of the pump 3.

A seventh embodiment of the device 10, 20 according to the sixth embodiment of the device 10, 20, further comprising one or more sensors 8, wherein the sensors are sensitive to one or more of: movement caused by an avalanche, $CO_2$ level above preset threshold, weight load/pressure, g-forces, power resource level such as battery capacity reserve, or sensor input crossing activation threshold such as: an oxygen content in a person's blood stream, heart rate or body temperature, and the one or more sensors 8 is connected via a sensor input interfaces 8' to the automatic activation unit 11 of the controller 6, wherein the controller 6 comprise a program for monitoring the sensor 8 readings and for controlling the operation mode of the device 10, 20 accordingly.

An eighth embodiment of the device 10, 20 according to any of the first to seventh embodiment of the device 10, 20, wherein automatic activation unit 11 comprise a manual switch 11', wherein the manual switch 11' can override the sensor inputs 8 and be used to manually activate the pump 3 at selected operation modus.

A ninth embodiment of the device 10, 20 according to any of the first to eighth embodiment of the device 10, 20, wherein the inlet 4 further comprising an inlet protection device 4' for protection of the inlet 4 against being clogged by snow, water or other substances.

A tenth embodiment of the device 10, 20 according to the ninth embodiment of the device 10, 20, wherein the inlet protection device 4' is formed by a light weight protection mesh.

An eleventh embodiment of the device 10, 20 according to the tenth embodiment of the device 10, 20, wherein the mesh being constructed of one of hard plastic or carbon material.

A twelfth embodiment of the device 10, 20 according to any of the ninth to eleventh embodiment of the device 10, 20, wherein the inlet protection device 4' may be filled with a gas permeable material.

A thirteenth embodiment of the device 10, 20 according to the twelfth embodiment of the device 10, 20, wherein the gas permeable material is a polyurethane sponge.

A fourteenth embodiment of the device 10, 20 according to any of the first to thirteenth embodiment of the device 10, 20, further comprising a feedback duct 110 for providing air from the outlet 1 surrounding environment to be fed into the pump 3 and hence back through the outlet 1.

A fifteenth embodiment of the device 10, 20 according to any of the first to fourteenth embodiment of the device 10, 20, further comprising a bypass duct 111 for bypassing the filter 2.

A sixteenth embodiment of the device 10, 20 according to any of the first to fifteenth embodiment of the device 10, 20, wherein the device is arranged in a backpack 40 assembly, wherein the inlet 4 and inlet protection device 4' is arranged at the lower end of the backpack 40, and the outlet 1 is arranged to be arranged close to the mouth and nose region of a bearer.

A seventeenth embodiment of the device 10, 20 according to any of the first to sixteenth embodiment of the device 10, 20, wherein the device is arranged in a bag or backpack 40 assembly, wherein the inlet 4 and inlet protection device 4' is arranged in the backpack 40 or bag assembly, and the inlet 4 comprises an extendable inlet pipe 7' or the outlet 1 comprise an extendable outlet pipe 7", 7'" such that the device 10, 20 could be arranged such that the inlet 4 is arranged away from a person, and the outlet 1 is arranged close to the face area of the person.

An eighteenth embodiment of the device 10, 20 according to any of the first to seventeenth embodiment of the device 10, 20, further comprising a wearable device, the wearable device 114 holding the outlet 1 such that it may be in a position close to nose/mouth of person wearing the device 10, 20.

A nineteenth embodiment of the device 10, 20 according to any of the first to eighteenth embodiment of the device 10, 20, further comprising an alarm 112, wherein the alarm 112 can be activated by the controller 6 if a detector 8 detects too high $CO_2$ level close to the outlet 1, the power resource level is below a preset threshold, or any detector detects levels outside preset acceptable levels.

A twentieth embodiment of the device 10, 20 according to any of the first to nineteenth embodiment of the device 10, 20, further comprising an additional inlet 115 for providing oxygen to the pump 3 from an inflated balloon.

A twenty-first embodiment of the device 10, 20 according to any of the first to twentieth embodiment of the device 10, 20, further comprising an oxygen filled container 116 for providing oxygen to the pump 3 from the oxygen filled container 116.

A twenty-second embodiment of the device 10, 20 according to any of the first to twenty-first embodiment of the device 10, 20, wherein the controller 6 further comprising a communication device, the communication device being able to transmit device 10, 20 status to a remote communication unit 101, 104, 105, 107.

A twenty-third embodiment of the device 10, 20 according to any of the first to twenty-second embodiment of the device 10, 20, wherein the communication device being able to receive operation instructions from a remote communication unit 101, 104, 105, 107.

A first system embodiment for providing extended life support to avalanche victim, wherein the system comprises one or more devices 10, 20 according to any of the previous claim 22 or 23, the system further comprise a remote communication unit 101, 104, 105, 107, and a communication transfer medium 102, 103, 106.

A second embodiment of the system according to the first embodiment of the system, wherein the remote communication unit 101, 104, 105, 107 is one of local alarm station 104 able to identify presence and no-distress signal of the devices 10, 20, remote server 101 able to monitor and communicate with other remote communication units 101, 104, 105, 107, search party 105 able to locate device 10, 20 merely by receiving a beacon 106 broadcasted by a device 10, 20, or an emergency transport 107.

A third embodiment of the system according to any of the first to second embodiment of the system, wherein the devices 10, 20 if further combined with other lifesaving equipment.

A fourth embodiment of the system according to the third embodiment of the system, wherein other lifesaving equipment is one or more of air inflating balloon for avalanche buoyancy, container comprising compressed oxygen, airbag for body protection, body heating equipment.

A first embodiment of a method for improving the breathable air quality in an environment using a device 10, 20 according to any of the first to twenty-third embodiment of the device 10, 20, the method comprising the following step:

the user turning on the device 10, 20;

activating the device 10, 20 upon one of automatic emergency detector 201 or the manual switch 202 being activated;

starting the pump 206.

A second embodiment of the method according to the third embodiment of the method, wherein the step starting the pump 206 comprise of one or more of the following steps being performed before starting the pump 206:

a) the controller 6 of the device 10, 20 performing a successful self-test and reading power source status and/or sensors status 203;

b) controller 6 selecting which device 10, 20 to activate 204, c) controller 6 selecting pump level 205 of selected pump 3, starting the pump 206 at selected pump level, and repeating step a to c at preset intervals for adjusting pump level or change device 10, 20.

It shall be understood that the embodiments only describe the principle of the invention, and that there may be additional ways to implement the present invention. It is the associated claims that shall define the protection scope of the present invention.

What is claimed is:

1. A device for improving the breathable air quality in an environment comprising:

at least one inlet, at least one pump, at least one power resource, a controller, and at least one outlet wherein;

the at least one inlet is connected with a pump inlet of the pump, and the at least one outlet is connected with a pump outlet of the pump, the inlet is constructed to act as a chamber wherein a first end of the chamber is connected to the pump inlet and a second end of the chamber is an opening towards the outside of the device, and the pump will, when activated, provide a vacuum in the chamber and suck air from the surroundings into the pump through the second end of the chamber and the chamber, and pump the air from the pump outlet to the outlet, wherein the device is integrated into the frame of a backpack, wherein the outlet is connected to the pump outlet via an air supply pipe, the air supply pipe being integrated into the backpack, and shoulder harness, the outlet being arranged in the shoulder harness close to a carrier's facial area.

2. The device according to claim 1, wherein the chamber is partially or completely filled with a with a formable air permeable foam material.

3. The device according to claim 1, wherein the inlet is in connection with the pump inlet via one or more inlet channel/pipe segment, connecting the inlet opening to the pump inlet.

4. The device according to claim 3, wherein the one or more of inlet channels/pipe segments connects to corresponding inlet openings being set apart to enlarge the volume of space from which air is sucked into the pump.

5. The device according to claim 4, wherein the inlet channels comprises a central inlet channel and a plurality of distributed inlet channels, wherein each distributed inlet channel connects at its peripheral end the corresponding air inlet to the central inlet channel in a connecting junctions, the central inlet channel having one or more connecting junctions connecting to each of, or group of, distributed inlet channels.

6. The device according to claim 1, wherein the outlet further integrated into a sternum strap, the outlet being arranged in the sternum strap close to a carrier's facial area.

7. The device according to claim 1, further comprising a pipe extender connected in one end to an outlet opening of the outlet and in the other end to the interior of a full face helmet worn by the carrier.

8. The device according to claim 1, further comprising a $CO_2$ filter for removal of $CO_2$ from the air supplied by the device.

9. The device according to claim 1, wherein the controller comprise an automatic activation unit for setting and controlling an operating mode of the pump.

10. The device according to claim 9, further comprising one or more sensors, wherein the sensors are sensitive to one or more of: movement caused by an avalanche, $CO_2$ level above preset threshold, weight load/pressure, g-forces, power resource level, or sensor input crossing activation threshold, and the one or more sensors is connected via a sensor input interfaces to the automatic activation unit of the controller, wherein the controller comprise a program for monitoring the sensor readings and for controlling the operation mode of the device accordingly.

11. The device according to claim 1, wherein automatic activation unit comprise a manual switch, wherein the manual switch can override sensor inputs and be used to manually activate the pump at selected operation modus.

12. The device according to claim 2, wherein the formable air permeable foam material is a polyurethane sponge.

13. The device according to claim 1, further comprising a feedback duct for providing air from the outlet surrounding environment to be fed into the pump and hence back through the outlet.

14. The device according to claim 1, further comprising a bypass duct for bypassing the filter.

15. The device according to claim 1, further comprising an additional inlet for providing oxygen to the pump from an inflated balloon.

16. The device according to claim 1, wherein the controller further comprising a communication device, the communication device being able to transmit device status to a remote communication unit.

17. A system for providing extended life support to avalanche victim, wherein the system comprises one or more devices according to claim 16, the system further comprise a remote communication unit, and a communication transfer medium.

18. The system according to claim 17, wherein the remote communication unit is one of local alarm station able to identify presence and no-distress signal of the devices, remote server able to monitor and communicate with other remote communication units, search party able to locate device merely by receiving a beacon broadcasted by a device, or an emergency transport.

19. A method for improving the breathable air quality in an environment using the device according to claim 1, the method comprising:

turning on the device;

activating the device upon one of automatic emergency detector or a manual switch being activated;

starting the pump.

20. The device according to claim 10, wherein the power resource level comprises battery capacity reserve and the sensor input crossing activation threshold comprises an oxygen content in a person's blood stream, heart rate or body temperature.

21. A device for improving the breathable air quality in an environment comprising:

at least one inlet, at least one pump, at least one power resource, a controller, at least one outlet, and one or more sensors, wherein;

the at least one inlet is connected with a pump inlet of the pump, and the at least one outlet is connected with a pump outlet of the pump, the inlet is constructed to act as a chamber wherein a first end of the chamber is connected to the pump inlet and a second end of the chamber is an opening towards the outside of the device, and the pump will, when activated, provide a vacuum in the chamber and suck air from the surroundings into the pump through the second end of the chamber and the chamber, and pump the air from the pump outlet to the outlet, wherein the controller comprise an automatic activation unit for setting and controlling an operating mode of the pump, and wherein the sensors are sensitive to one or more of: movement caused by an avalanche, $CO_2$ level above preset threshold, weight load/pressure, g-forces, power resource level, or sensor input crossing activation threshold, and the one or more sensors is connected via a sensor input interfaces to the automatic activation unit of the controller, wherein the controller comprise a program for monitoring the sensor readings and for controlling the operation mode of the device accordingly.

22. The device according to claim 21, wherein the power resource level comprises battery capacity reserve and the sensor input crossing activation threshold comprises an oxygen content in a person's blood stream, heart rate or body temperature.

* * * * *